United States Patent [19]

Johnson et al.

[11] 3,951,085

[45] Apr. 20, 1976

[54] FLOATING STRUCTURE ARRANGEMENT

[76] Inventors: Don E. Johnson, 256 N. Fraser West, Mesa, Ariz. 85203; Robert M. Jones, 531 E. Las Palmas, Fullerton, Calif. 92631

[22] Filed: Apr. 2, 1975

[21] Appl. No.: 564,419

Related U.S. Application Data

[63] Continuation of Ser. No. 385,689, Aug. 6, 1973, abandoned.

[52] U.S. Cl. ..... 114/.5 F; 52/583; 52/587; 114/65 A

[51] Int. Cl.[2] ..... B63B 35/00

[58] Field of Search ..... 114/.5 F, .5 R, .5 BD, 114/65 A; 61/48; 52/70, 583, 585, 587, 600, 745

[56] References Cited

UNITED STATES PATENTS

| | | | |
|---|---|---|---|
| 1,276,624 | 8/1918 | Cummings | 114/65 A |
| 2,920,475 | 1/1960 | Graham | 52/587 |
| 3,276,209 | 10/1966 | Mosdell | 114/.5 F |
| 3,386,252 | 6/1968 | Nelson | 52/583 |
| 3,494,092 | 2/1970 | Johnson et al. | 52/583 |
| 3,665,882 | 5/1972 | Georgiev | 114/.5 F |
| 3,691,974 | 9/1972 | Seiford et al. | 114/.5 F |
| 3,779,192 | 12/1973 | Gonzalez | 114/65 A |
| 3,788,254 | 1/1974 | Sheil | 114/.5 F |

*Primary Examiner*—Trygve M. Blix
*Assistant Examiner*—Charles E. Frankfort
*Attorney, Agent, or Firm*—Gausewitz, Carr & Rothenberg

[57] ABSTRACT

An arrangement for providing a floating structure in which triangular modules are formed from flat slabs of ferrocement interconnected by rods which are bent to provide a triangular shape, the rods being interconnected at the portions between the slabs to provide larger triangular units, to which are applied reinforced concrete skins including wire mesh and rods extending from the apexes to the opposite sides to provide outwardly projecting portions for attachment in still larger units. Alternatively, modules may be made by casting in a mold which defines triangular sections, between which are spaces in which are placed reinforcing units that include rods and wire mesh, with the rods projecting outwardly beyond the mold to provide end portions used in assembling the modules into larger units.

19 Claims, 37 Drawing Figures

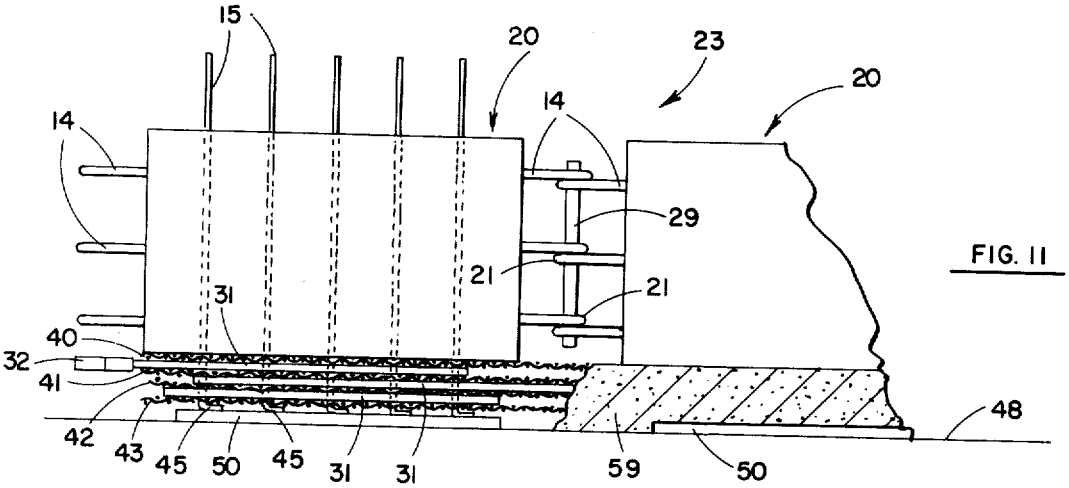
FIG. 11
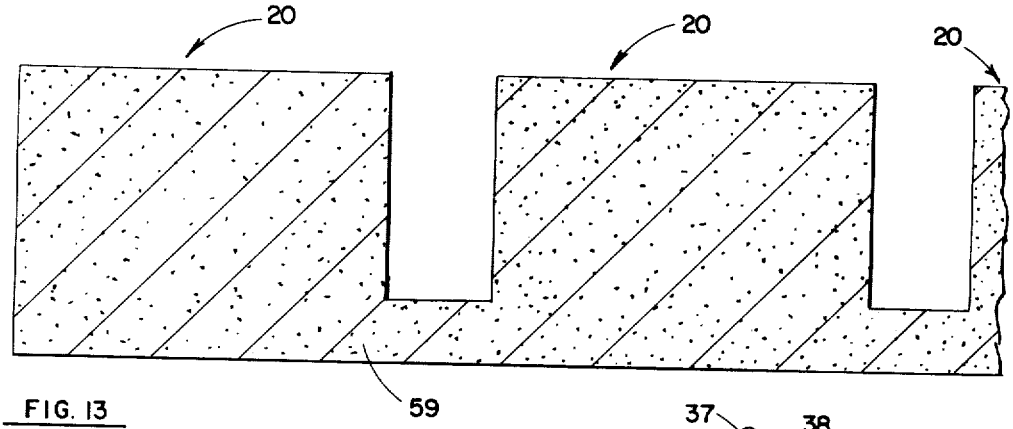
FIG. 13
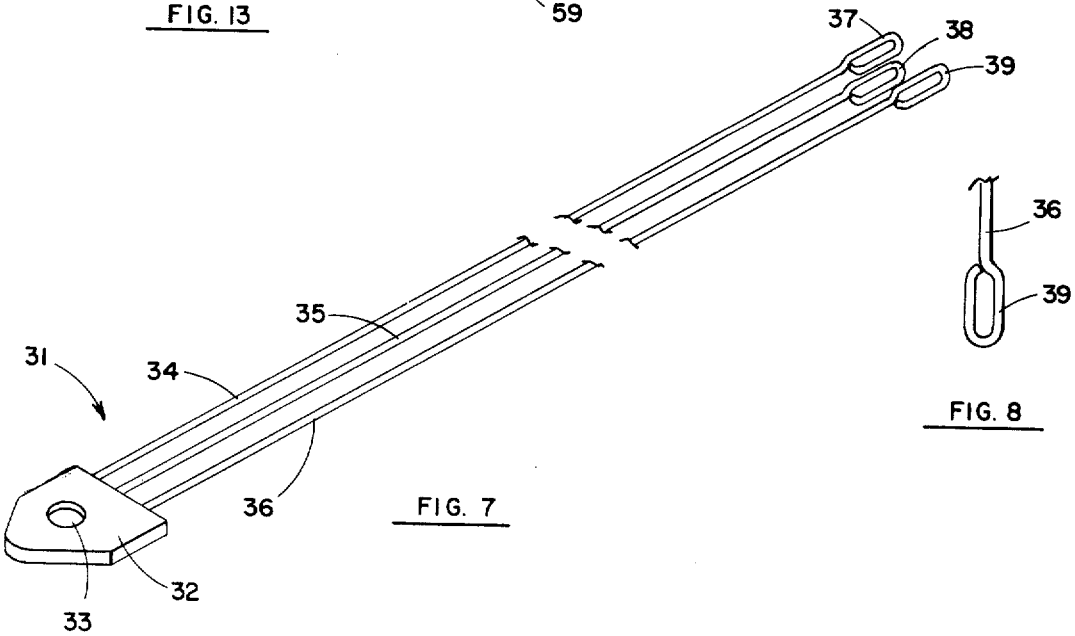
FIG. 8
FIG. 7

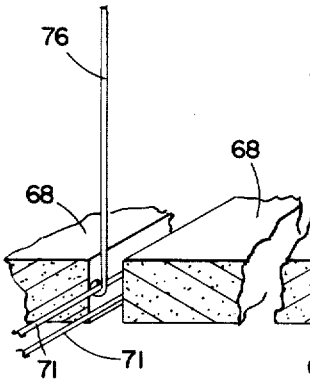
FIG. 21
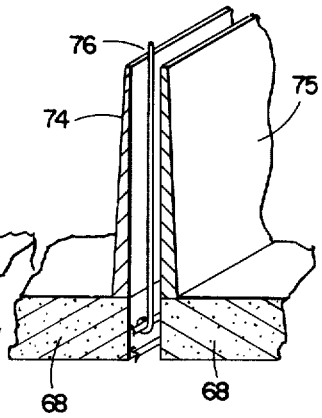
FIG. 22
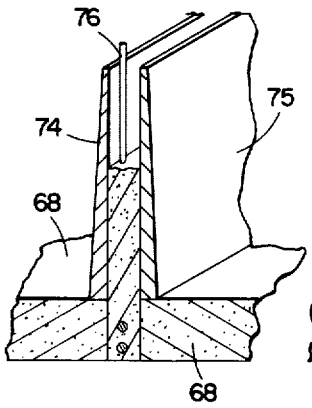
FIG. 23
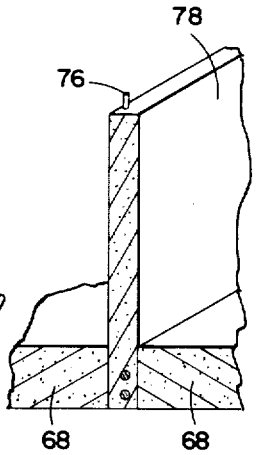
FIG. 24
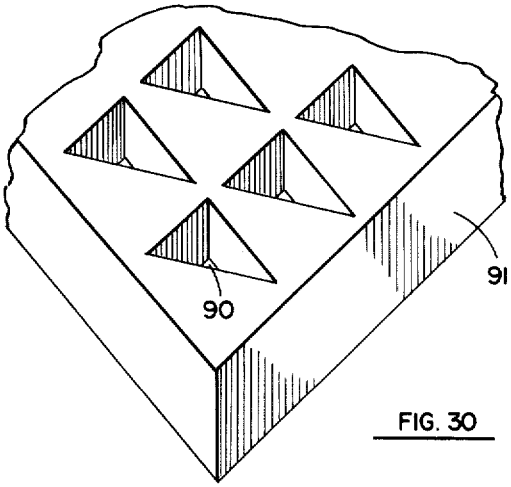
FIG. 30
FIG. 10
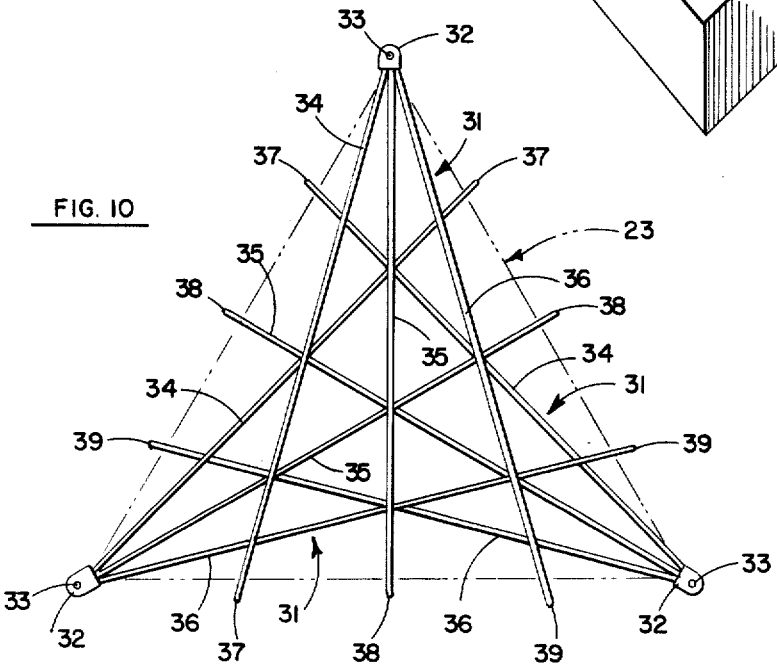

FIG. 20
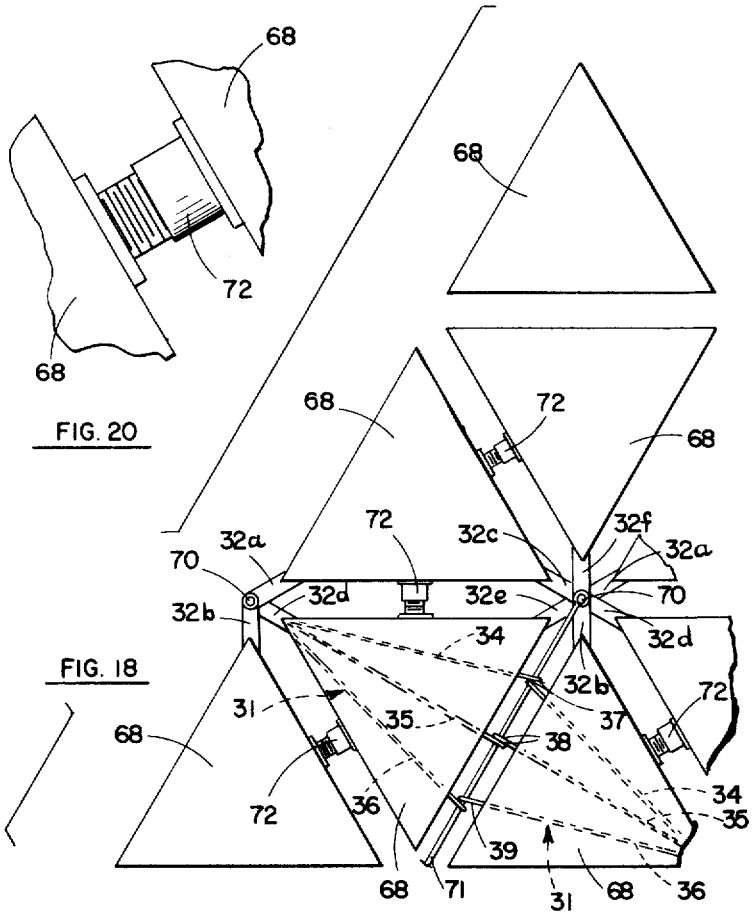
FIG. 18
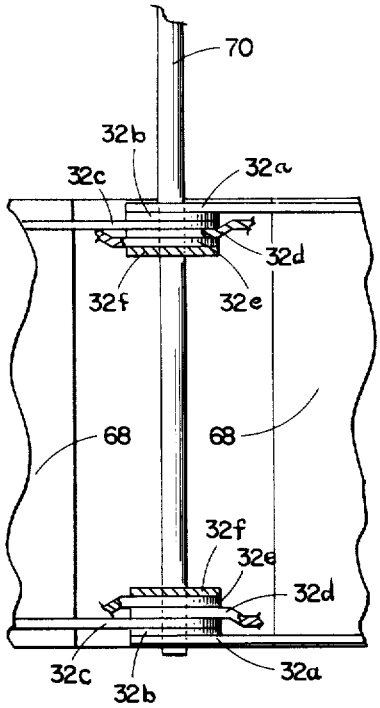
FIG. 19
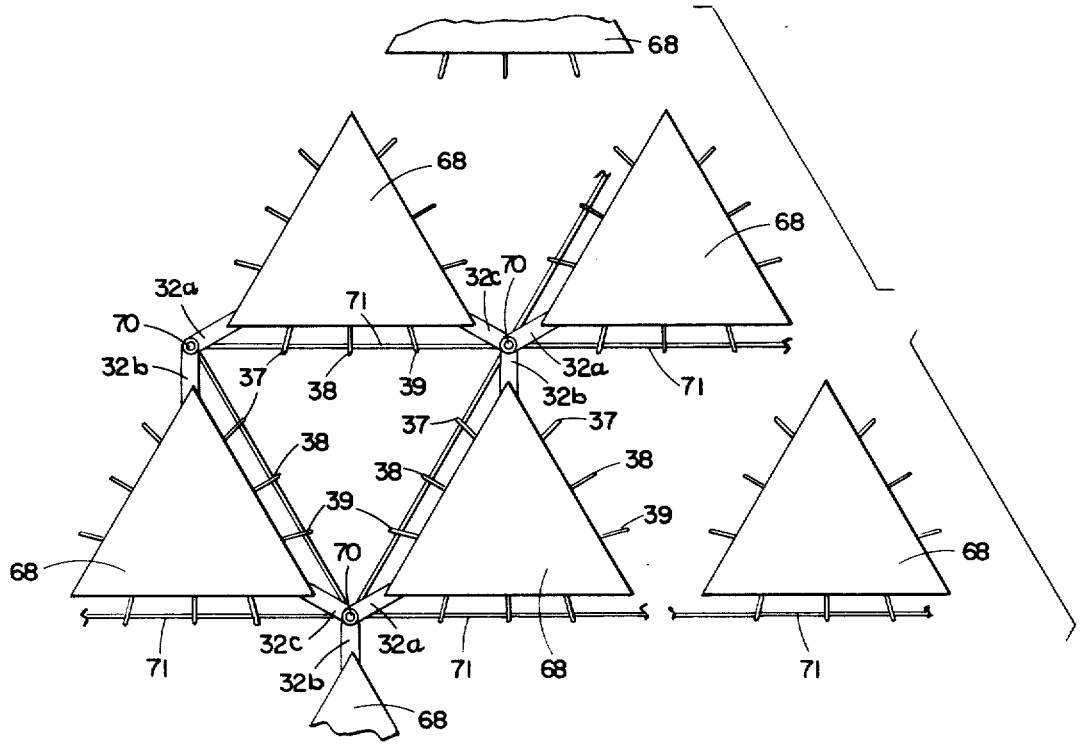
FIG. 27

FIG. 32
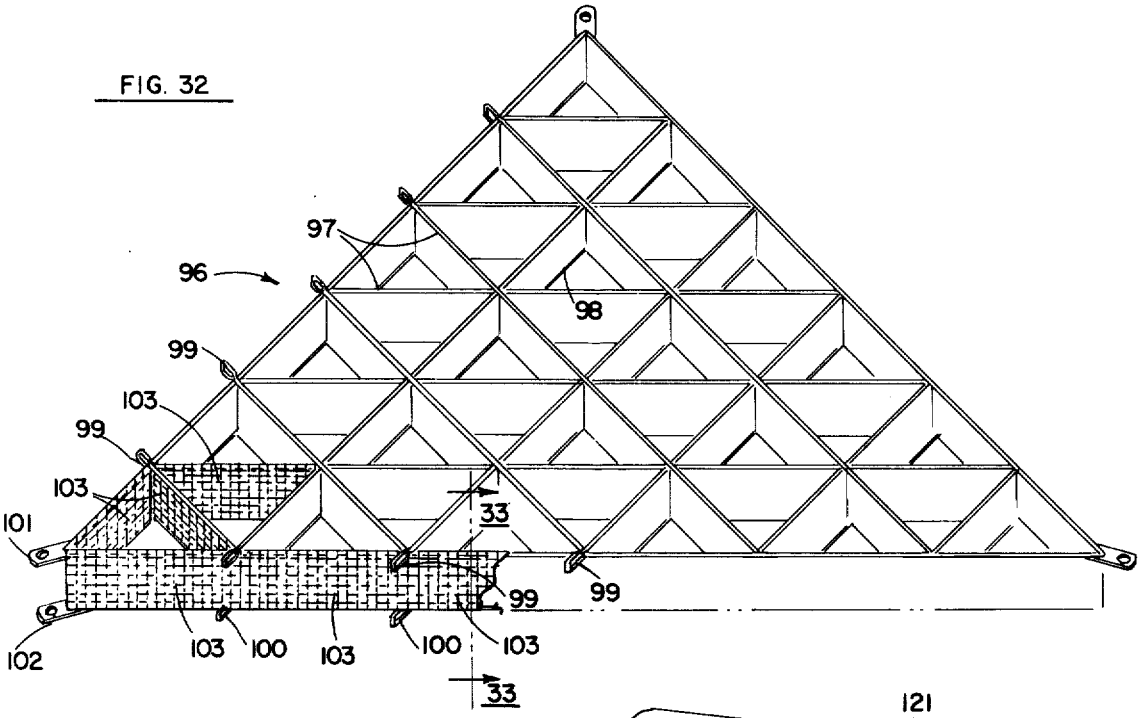
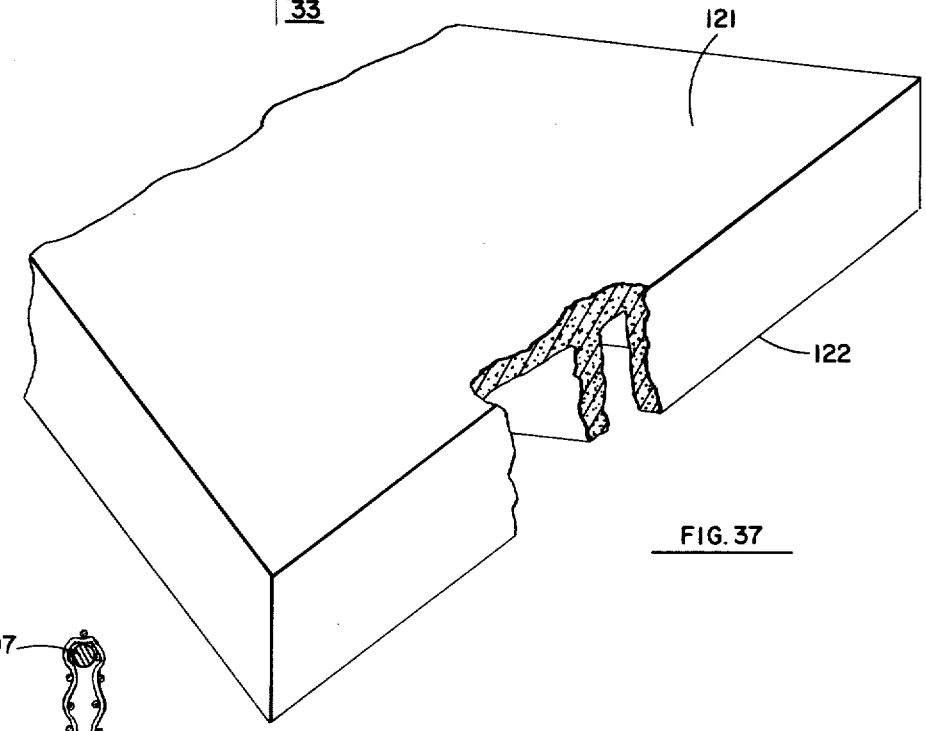
FIG. 37
FIG. 33
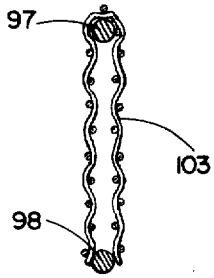

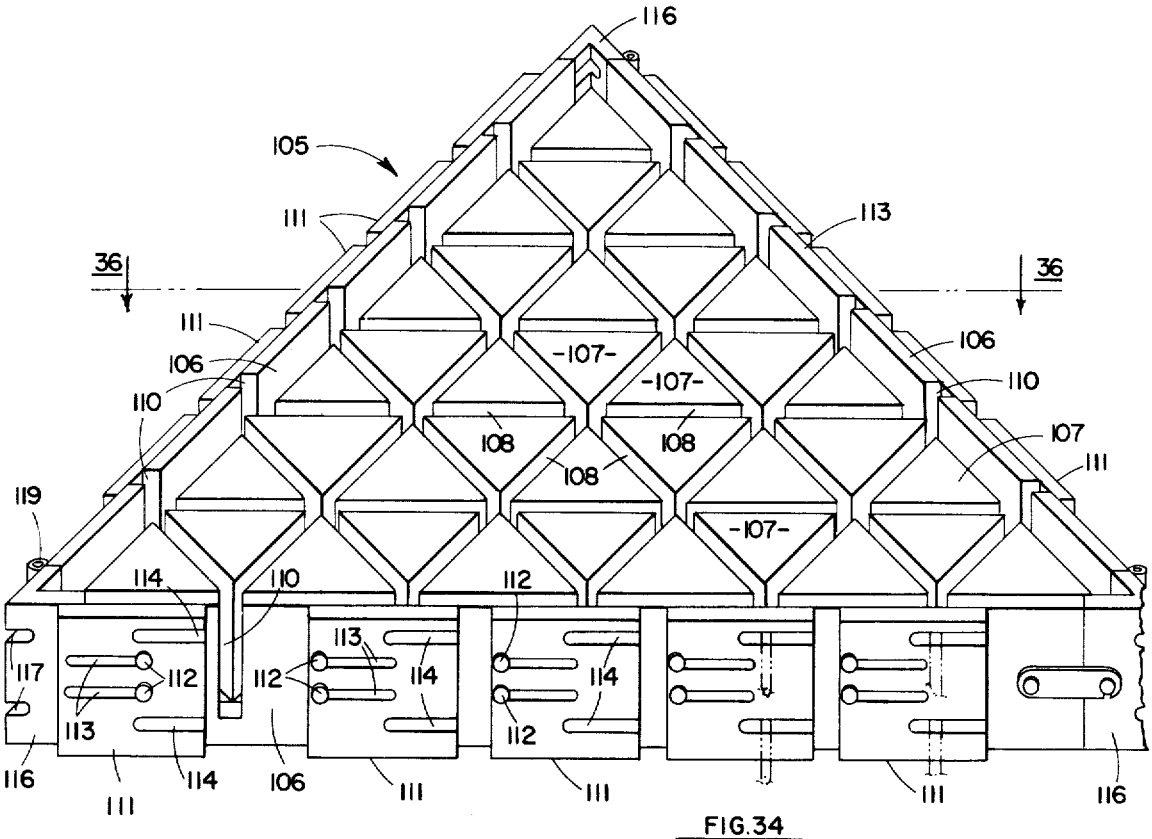
FIG. 34
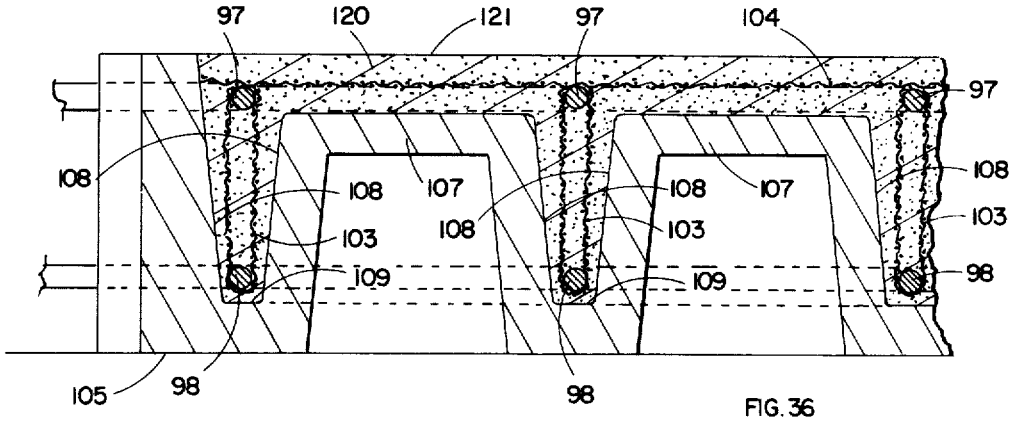
FIG. 36
FIG. 35
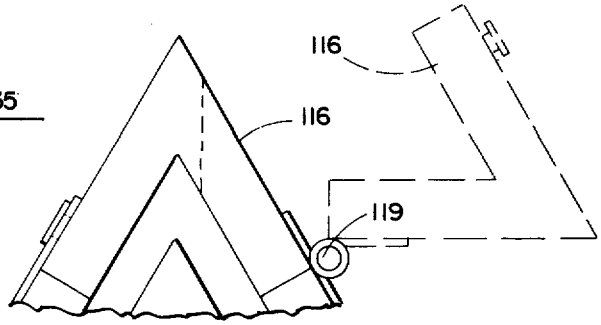

FLOATING STRUCTURE ARRANGEMENT

This is a continuation of application Ser. No. 385,689, filed Aug. 6, 1973, now abandoned.

BACKGROUND OF THE INVENTION

1. Field of the Invention

This invention relates to an arrangement for providing a floating structure.

2. The Prior Art

In the past, there has been recognized the desirability of providing man-made structures which can function as small islands. There have been proposals for the construction of such units of concrete. Generally, however, they have been expensive and difficult to produce. The structures have been heavy and lacked needed buoyancy. The prior designs also have not been capable of assembly into larger units securely held together as unitary structures.

SUMMARY OF THE INVENTION

The present invention provides for the modular construction of floating reinforced concrete structures, permitting the assembly of man-made islands of almost any desired size. The basic unit in the structure may be provided by a triangular module consisting of three flat slabs of ferrocement interconnected by rods. These units initially are planar, with the rods between the slabs subsequently being bent to provide a triangular configuration. These triangular modules are associated together to form a larger triangular assembly which is secured together by rods extending through the loops formed by the rods at the apexes of the triangular modules. By pointing all of the triangular modules in the same direction in forming the larger triangular structure, the resulting unit has more triangles within its perimeter than the total number of the modules present. The spaces at the apexes of the triangular modules are filled in with more ferrocement, and the larger triangular unit is provided with reinforced skins. Reinforcement comes from wire mesh together with rod units which extend from each apex to a point just beyond the opposite side, providing projecting loops along the sides and at the corners of the triangular unit. The unit then is placed in a mold having a thin layer of ferrocement on the bottom surface, which then is vibrated to cause the ferrocement to penetrate the wire mesh and surround the reinforcing rod in defining the skin. Both surfaces of the unit may be enclosed in this manner.

Still larger assemblies are made from the bigger modules, again preferably being of triangular shape. In these larger units, the loop ends of the reinforcing rods are engaged by horizontal rods which are attached together at their ends, providing a particularly strong reinforcement that will transmit stresses throughout the unit in any direction. Jacks may be placed between adjacent triangles to cause the reinforcing rods to be prestressed. The larger triangular units are provided with vertical walls to give them depth and with additional skin surfaces to define areas upon which subsequent construction may be made during use of an assembled island.

The structures may be made into floating islands of almost any desired size by associating together the triangular assemblies as desired to produce the shapes and sizes that may be needed. The islands may be towed or self-powered for movement to desired locations. When anchored, they are stable and not adversely affected by waves.

As an altenate to the modules formed from the bent flat units, they may be produced by a casting process in which the mold defines triangular compartments by virtue of which the internal walls can provide a honeycomb construction. Reinforcing rod units extend into the wall areas, two units in a spaced relationship normally being employed. These are interconnected by wire mesh. When the concrete is cast into the mold, vibration assists it in penetrating the wire mesh and in entirely filling the spaces within the mold.

BRIEF DESCRIPTION OF THE DRAWING

FIG. 7 is a perspective view of one of the strength units used in providing reinforcement for a skin to be formed on the triangular assembly of FIG. 4;

FIG. 8 is a fragmentary elevational view illustrating the loop end on one of the rods of the strength unit;

FIG. 10 is a top plan view illustrating how the rods of the strength units are extended across the triangular assembly; FIG. 11 is a fragmentary elevational view, partially broken away, showing the construction of the reinforced skin for the triangular assembly of FIG. 4;

FIG. 13 is a sectional view showing the completed unit with the skin attached thereto;

FIG. 18 is a fragmentary plan view illustrating one way of assembling into a larger triangular unit the triangular assemblies of FIG. 17.

FIG. 19 is an enlarged fragmentary elevational view showing how the overlapping reinforcements at the corners of the triangular assemblies are secured together;

FIG. 20 is a fragmentary enlarged plan view illustrating how a jack may be employed in prestressing the reinforcements of the triangular unit of FIG. 18;

FIGS. 21, 22, 23 and 24 are fragmentary perspective views, partially in section, showing sequentially how walls are formed at the junctures of the triangular units making up the larger triangular assembly;

FIG. 27 is a fragmentary plan view of a different way of assembling the triangular units of FIG. 17;

FIG. 30 is a fragmentary perspective view of the completed assembly in an inverted position;

FIG. 32 is a perspective view of the reinforcing assembly used in forming a cast module;

FIG. 33 is a fragmentary sectional view taken along line 33—33 of FIG. 32;

FIG. 34 is a perspective view of the mold for forming the cast module;

FIG. 35 is a fragmentary plan view showing how the mold is closed at its corners;

FIG. 36 is a sectional view taken along line 36—36 of FIG. 34, but with the reinforcement and cement within the mold; and FIG. 37 is a fragmentary perspective view of the completed cast module.

DESCRIPTION OF THE PREFERRED EMBODIMENT

Figure 1:
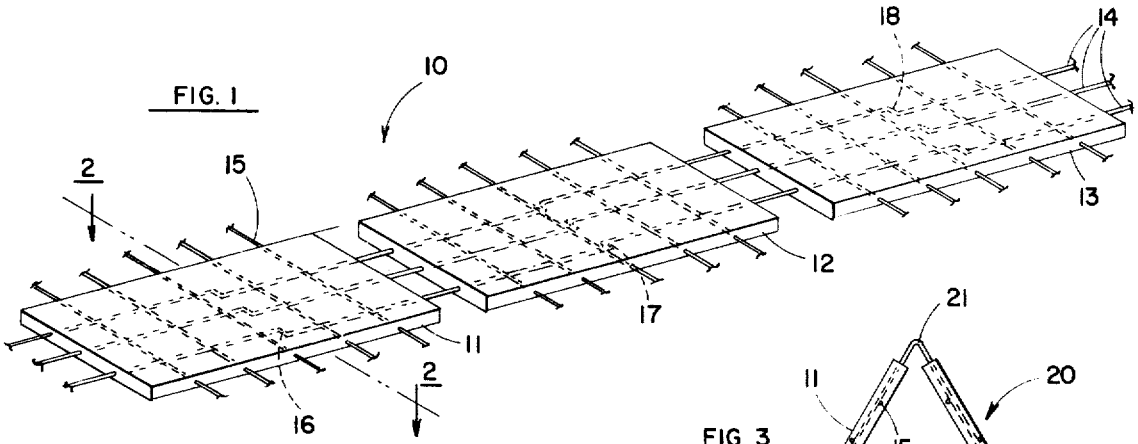
FIG. 1 is a perspective view of an assembly of rods and concrete slabs which is used to form a triangular module.
Figure 2:
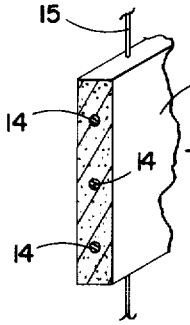
FIG. 2 is a transverse sectional view taken along line 2—2 of FIG. 1, showing the relationship of the reinforcing rods and the cement slab.

In providing a basic triangular module for use in producing a floating structure, there may first be prepared a flat unit 10, such as shown in FIG. 1. This includes three flat rectangular slabs 11, 12 and 13, preferably of ferrocement which has a low-density aggregate, as a result of which the slabs are relatively light in weight. Rods 14 extend longitudinally through the three slabs 11, 12 and 13. Additional transverse rods 15, normally of smaller diameter than the longitudinal rods 14, also extend through the slabs 11, 12 and 13. The rods 15 project outwardly beyond either side edge of each of the cement slabs, while the rods 14 project outwardly from either end of the unit 10.

Within the slab 11, the rods 14 are given jogs 16 in one direction, so that intermediate the slabs 11 and 12 the rods 14 are parallel but displaced to one side relative to the portions of the rods 14 projecting from the opposite end of the slab 11. Similarly, there are bends 17 in the rods 14 in the slab 12, so that intermediate the slabs 12 and 13 the rods 14 are displaced laterally in the opposite direction. A further bend 18 is provided in the rods 14 within the slab 13, so that the portions of the rods 14 projecting from the outer end of the slab 13 correspond in position to the ends of the rods 14 projecting from the slab 11. Thus, the sections of the rods 14 at the ends of the unit 10 are in alignment. They are misaligned, however, with the portions of the rods 14 between the slabs 11 and 12, which are, in turn, also misaligned with the portions of the rods 14 between the slabs 12 and 13.

The use of the flat unit 10 adapts the construction of an island in accordance with this invention to factory production of the basic components, while permitting the structural members to be stacked compactly for storage and for shipment to a job site.

Figure 3:
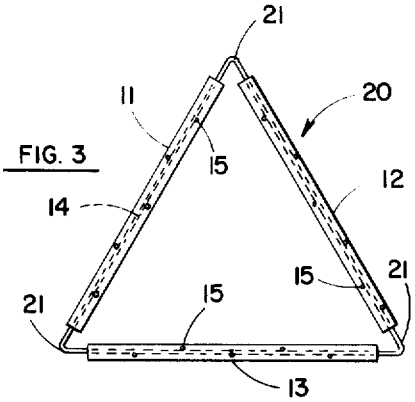
FIG. 3 is a top plan view of a triangular module produced from the unit of FIG. 1.

The units 10 may be bent to a triangular configuration, such as shown in FIG. 3, at the location where the island is to be assembled. In accomplishing this, the portions of the rods 14 intermediate the slabs 11 and 12, and between the slabs 12 and 13, are bent at their central portions to angles of 60°. This brings the ends of the rods 14 beyond the slabs 11 and 13 into abutment, after which they are welded to provide a rigid triangular structure. The result is an equilateral triangular module 20 having loops 21 at its apices provided by the exposed portions of the rods 14.

Figure 4:
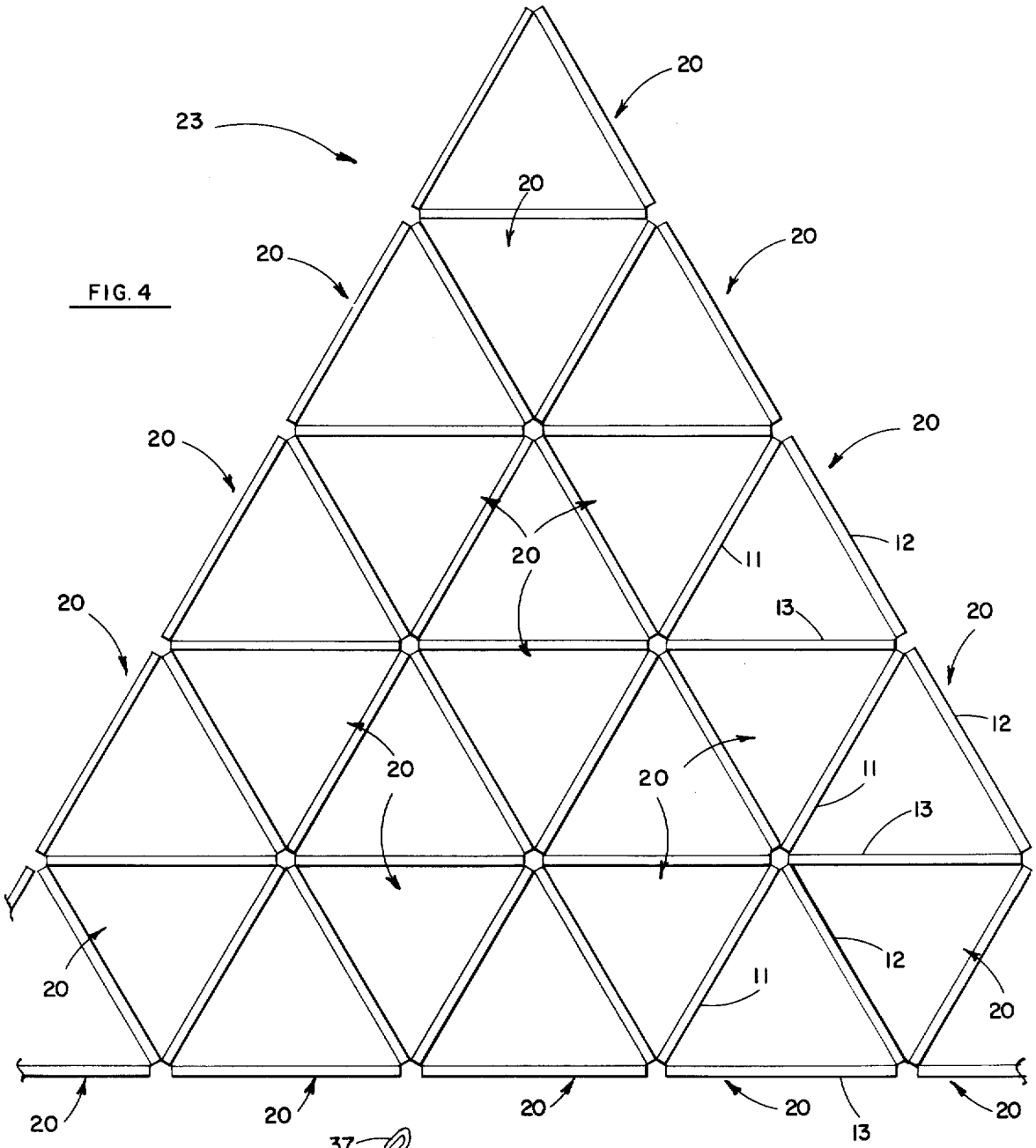
FIG. 4 is a top plan view illustrating the manner in which a number of the modules of FIG. 3 may be associated to form a larger triangular unit.

Next, a desired number of the triangular modules 20 are grouped together to form a larger unit 23, such as illustrated schematically in FIG. 4. Desirable results are obtained when the unit 23 also is made triangular in shape. In the arrangement of FIG. 4, the triangles 20 are in parallel rows, in each of which the bases of the triangles are aligned. The apices of the triangles 20 at their bases and between the adjacent rows are brought into adjacency. In the larger triangle 23 of FIG. 4, therefore, there are five triangles 20 in the bottom row 24, four triangles 20 in the next row 25, three triangles 20 in the row 26 above it, and two triangles 20 in the fourth row 27. At the top, as the unit 23 is illustrated, there is a single triangle 20. Although sixteen modules 20 are included, the resulting assembly provides a total of 25 triangles. This occurs because additional triangles are provided by the spaces between the adjacent triangles 20. In the unit 23, all of the triangles pointing downwardly are defined by spaces between the units 20, which are pointing upwardly. Different numbers of the triangles 20 may be associated together in providing a larger triangular unit 23 of desired size. In any event, a larger number of total triangles is produced than the number of the units 20 present. Thus, the assembled unit 23 occupies greater volume than the total of the individual volumes of the units 20.

Figure 6:
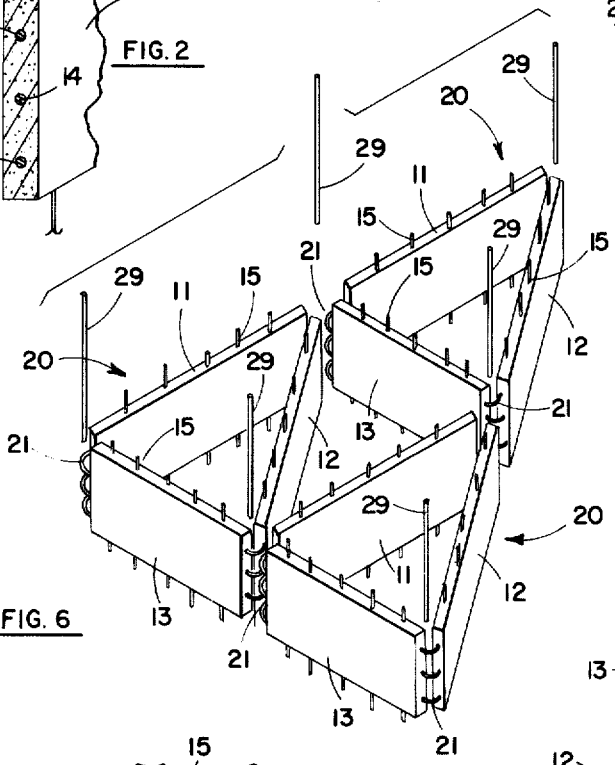
FIG. 6 is an exploded perspective view illustrating the way in which the triangular modules of FIG. 3 are attached together for providing the triangular unit of FIG. 4.
Figure 5:
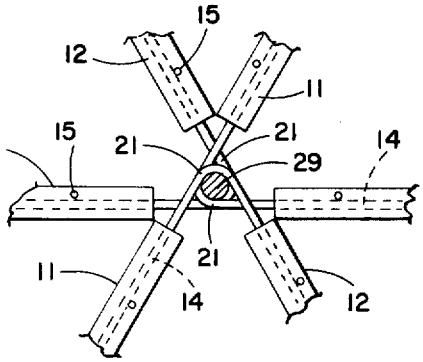
FIG. 5 is a fragmentary plan view showing the connection at the corners of the grouped modules.

In connecting the triangular units 20 together to produce the larger unit 23, the loops 21 at the corners of the adjacent triangles are overlapped, defining openings through which are extended rods 29 (see FIGS. 5 and 6). This overlapping of the corner loops 21 is possible because of the jogs 16, 17 and 18 in the rods 14 which place the loops 21 at different levels at the three corners of the modules 20. The rods 29 are attached to the loops 21 by a suitable means, such as welding. Therefore, the assembled triangular modules 20 are rigidly secured together and, when aligned in an appropriate jig as the welds are made, they provide a unit 23 that is accurately shaped to close tolerances.

After the triangular modules have been connected together in the larger unit 23, skins are attached to the opposite surfaces of the unit 23, producing a sealed, hollow, honeycomb-type structure.

Figure 9:
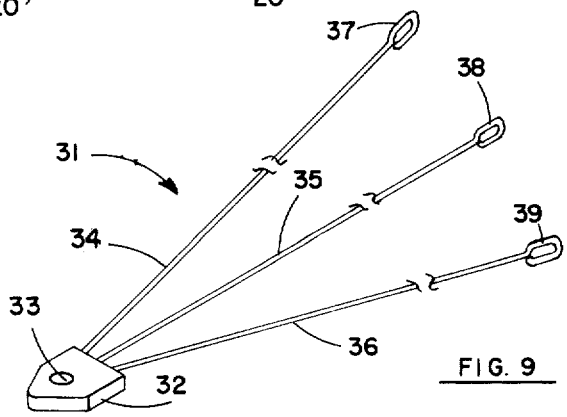
FIG. 9 is a perspective view of the strength unit with the rods unfolded.

Buried within the skins that are secured to the unit 23 are reinforcements which provide a means of transmitting force through the unit 23 and through a larger assembly made up of several of the units 23. This reinforcement includes a strength unit 31 having a flat plate 32 at one end through which is an aperture 33. Rods 34, 35 and 36 extend outwardly from the plate 32. These rods are doubled over at their outer ends to provide elongated loops 37, 38 and 39. For compactness in shipping and storage as well as simplicity in manufacture, the units 31 are made with the rods 34, 35 and 36 parallel, as shown in FIG. 7. At the time of use, however, the rods 34 and 36 at the sides of the unit 31 are bent outwardly at predetermined angles, as illustrated in FIG. 9. The rods 34 and 36 are longer than the central rod 35, so that when the rods are spaced apart their end loops 37, 38 and 39 fall along a straight line.

Three units 31 are used for each skin of the triangular assembly 23. The plates 32 are positioned just outwardly of the three apices of the assembly 23. This causes the rods 34, 35 and 36 of each strength unit 31 to extend from an apex across the unit 23 to the opposite side, locating the loops 37, 38 and 39 just beyond the opposite side (see FIG. 10).

Layers of wire mesh, substantially coterminous with the triangular unit 23, also are included in the skins. Typically, there are four layers 40, 41, 42 and 43 covering the strength units 31, as seen in FIG. 11. There are in succession positioned a layer of wire mesh 40, a first unit 31, the layer of wire mesh 41, then the second strength unit 31, followed by the third layer of wire mesh 42, beyond which is the third unit 31, and on the exterior a final layer of wire mesh 43.

The prongs provided by the outwardly projecting portions of the rods 15 of the modules 20 are extended through the layers of wire mesh and the strength units 31. The outer ends 45 of the rods 15 are bent over, as shown in FIG. 11, to overlie the outer layer 43 of wire mesh, helping to tie the assembly together. The rods 34, 35 and 36 of the strength units 31 will be adjacent some of the rods 15. At those locations, welds are made as the parts are being assembled, further unifying the reinforcement for the skin.

Figure 12:
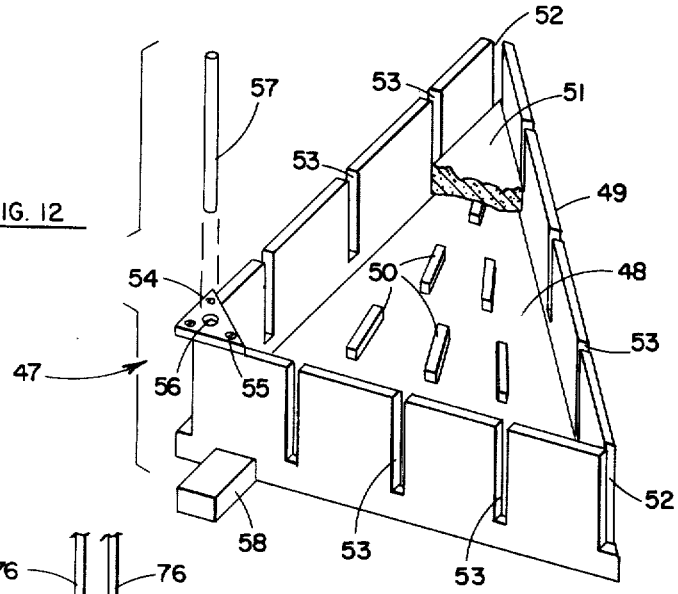
FIG. 12 is a perspective view of a mold used for forming the skin.

A triangular form or mold 47 is prepared, having a flat triangular bottom wall 48 from which extend vertical sidewalls 49 (FIG. 12). This defines a cavity dimensioned to receive the unit 23. Thin strips of cured concrete 50 are positioned on the mold 47. Next, a quantity of ferrocement 51 is poured into the mold cavity to cover the bottom wall 48 to a predetermined depth which is greater than the thickness of the concrete strips 50. After this, the unit 23 with the reinforcing assembly attached to it is inverted and placed within the mold 47, so that the reinforcing unit rests on the layer of cement 51. Slots 52 are provided at the corners of the mold to allow the ends of the strength units 31 to fit through them and extend out of the mold. Additional slots 53 in the sidewalls accommodate the rods 34, 35 and 36 so that the loops 37, 38 and 39 can be positioned outside of the mold. Corner plates 54 then are secured by fasteners 55 to the apices of the mold 47 above the unit 23 at the upper edges of the sidewalls 49. These plates are provided with apertures 56 through which guide rods 57 are extended. The guide rods 57 extend through the openings 33 in the plates 32 of the strength units 31 at the corners of the unit 23. This helps index the unit 23 with respect to the mold 47, so that it assumes a proper position centrally aligned within the form.

With the unit 23 positioned in this manner, the form 47 is vibrated by a vibrator 58. This causes the reinforcing assembly at the bottom surface of the unit 23 to penetrate into the ferrocement 51. Thus, the unit 23 moves downwardly into the cement 51, which permeates the reinforcing assembly, passing through the interstices formed by the strength units 31 and the layers of wire mesh 40, 41, 42 and 43. The ferrocement 51 has a fine aggregate so that it can pass through the openings in the wire mesh as the vibration takes place. The downward movement of the unit 23 is limited by the concrete strips 50 on the bottom surface 48 of the form 47. While some of the ferrocement 51 will tend to run out of the slots 52 and 53, very dry mixtures are used with this type of cement so that not much of it will escape from the mold. If desired, additional cement may be introduced into the bottom of the mold through the openings defined by the modular units 20, and the inner surface of the concrete in the form 47 within the triangles may be finished off. The cement 51 then is permitted to cure, thereby providing a completed skin that is integral with the triangular unit 23.

The bond between the unit 23 and the cement 51 may be improved by applying epoxy resin to the unit 23 along the edges of the individual modules 20 prior to introducing the unit 23 into the form 47. Epoxy resin also may be applied to the exposed surfaces of the concrete strips 50, so that they are attached securely to the skin thereby produced.

Figure 15:
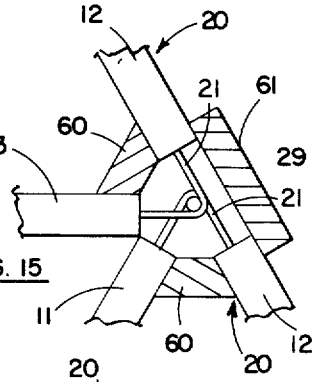
FIG. 15 is a similar view showing how the forms are positioned for filling the spaces occurring along the sides of the triangular assembly.
Figure 14:
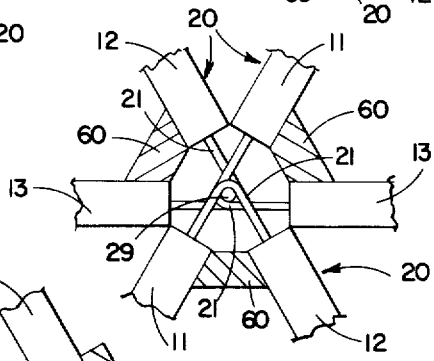
FIG. 14 is a fragmentary plan view illustrating the positioning of forms to retain cement used to fill in the spaces at the apexes of the triangular modules making up the assembly of FIG. 4.
Figure 16:
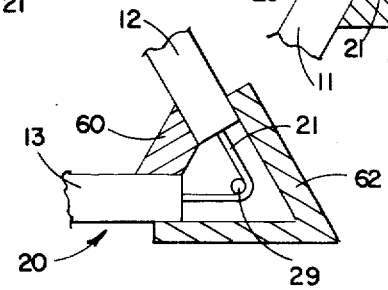
FIG. 16 is a similar view illustrating the positioning of the forms for filling the spaces at the corners of the triangular assembly.

After the cement 51 has cured, the unit 23 with its integral skin 59 is removed from the form 47. Following this, cement is applied to the interior of the unit 23 to fill the spaces at the apices of the modular units 20. Forms 60 are positioned at the apices of the units 20, as shown in FIG. 14, to confine the cement to the corner locations. Where the apices of the units 20 are along the side edge of the unit 23, an additional flat form 61 is used in containing the cement that is introduced into the opening provided by the forms (FIG. 15). At the three corners of the unit 23 are V-shaped forms 62 for a similar purpose (FIG. 16). Again, the use of an epoxy resin prior to introducing the cement into the openings will improve the bond between the additional cement and that of the units 20. This embeds the loops 21 and the rods 29 within the ferrocement.

Figure 17:
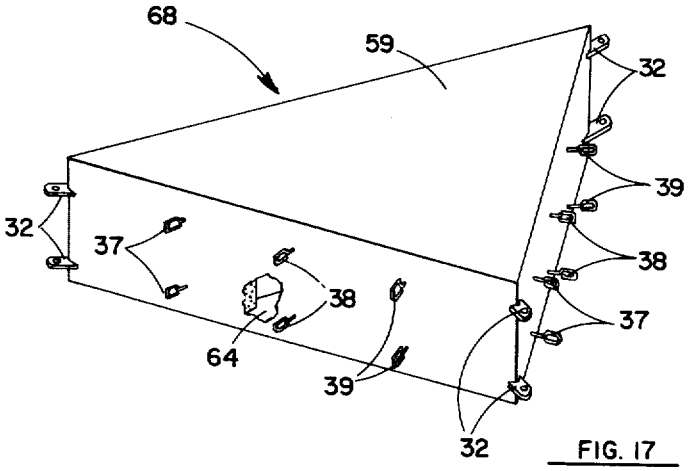
FIG. 17 is a perspective view of the completed triangular assembly.

After this step, an additional reinforcing assembly is applied to the open end of the unit 23. This reinforcement is the same as that used for the skin 59. Thus, it includes strength units 31 radiating outwardly from the apices of the unit 23, with intermediate layers of wire mesh 40, 41, 42 and 43. Again, the rods 15 are welded to the rods 34, 35 and 36 where they are engaged, and their ends are bent over the outer layer 43 of wire mesh. Cement strips 50 are again positioned on the bottom surface 48 of the form 47 and a predetermined quantity of the ferrocement 51 is cast into the mold. The open side of the unit 23 with the reinforcement attached then is placed downwardly in the mold, and the indexing pins 57 are used to position the unit 23 accurately within the mold. The mold 47 then is vibrated to cause the reinforcement to enter the cement 51, with the downward travel of the unit 23 being limited by the strips 50. After the form 47 has been vibrated sufficiently to cause the cement to enter the reinforcement and to reach the edges of the modules 20, the cement is allowed to cure, resulting in the production of the second skin 64. The unit 23, with the skins 59 and 64 attached, results in a triangular, sealed, honeycomb unit 68, as shown in FIG. 17.

The triangles 68 produced in this manner then are associated into still larger units. In producing these bigger modules, which again may be triangular in form, the triangles 68 may be grouped in a way generally similar to that of the triangles 20 which made up the units 23. In other words, the triangles 68 may be positioned so that they all point in one direction and are in rows so that the spaces between them help define a larger total number of triangles than the number of units 68 making up the unit. Alternatively, if desired, a solid structure may be produced by including a triangle 68 in each of the spaces of the assembly. In the latter instance, as shown in FIG. 18, the triangles 68 point in opposite directions and are located with their sides in spaced parallelism. In such a construction, the apexes of the adjacent triangles are equally spaced apart so that they would fall on an imaginary circle having its center at the midpoint of the grouped apexes. The straps 32 projecting from the triangles 68 are positioned in an overlapping relationship at the junctures of the apexes and the openings 33 through them are in alignment.

In order to permit the association of the triangles 68 in this relationship, it is necessary to stagger the straps 32 vertically so that they will overlap and not interfere with each other. This is accomplished by providing a first group of triangles 68 having the straps of the strength units 31 in three different height positions at the three corners of the triangle. In other words, as seen in FIG. 19, these triangles include straps 32*a* at one corner, which are closely adjacent the outer surfaces of the skins 59 and 64. At a second apex, the straps are displaced inwardly substantially the thickness of the straps 32*a* to provide the straps 32*b* further beneath the surfaces of the skins 59 and 64. At the third corner of these triangles 68 are straps 32*c* displaced inwardly an additional strap thickness and so are at a greater distance beneath the surfaces of the skins 59 and 64. This displacement of the straps 32*b* and 32*c* may be accomplished by bending.

A second group of triangles 68 is provided, having straps 32*d*, 32*e* and 32*f* at its three corners similarly displaced progressively further inwardly from the outer surfaces of the skins 59 and 64. The straps 32*d*, which are closest to the skins 59 and 64, are displaced just beyond the positions of the straps 32*c*.

In the assembly, the first group of triangles 68 with the straps 32*a*, 32*b* and 32*c* are all arranged pointing upwardly, while those with the straps 32*d*, 32*e* and 32*f* point downwardly. When arranged as shown, the straps 32*b* all are at the top, while the straps 32*a* and 32*c* are at the lower left- and right-hand corners of the first group of triangles 68. The straps 32*f* are at the downward points of the other group of triangles 68, with the straps 32*d* and 32*e* being at the upper left- and right-hand corners of these triangles. This permits all of the straps to be associated at the adjacent corners of the triangles, with the straps being overlapped and their openings 33 in vertical alignment. Of course, at the side edges of the grouping of triangles, only three of the straps will be present, but again the overlapping relationship occurs. With the triangles 68 positioned in this manner, pins 70 are extended down through the aligned strap openings 33, and these pins are welded in place to the straps to form an integrated unit.

The strength units 31 also are arranged so that the outwardly projecting loops 37, 38 and 39 of the adjacent triangles 68 are positioned in a side-by-side relationship along the adjacent sides of the triangles. This requires some displacement of the loops 37, 38 and 39 for certain of the triangles so that the loops on adjacent triangles will not interfere with each other. Horizontal rods 71 then are threaded through the loops 37, 38 and 39 of the strength units 31 in the adjacent triangles and welded to these loops. Thus, there is a direct tie from each rod 34 in any triangle 68 to the rod 34 of the adjacent side of the adjoining triangle 68. The same holds true of the other rods 35 and 36. Consequently, stresses are readily taken out and transmitted throughout the entire assembly, and a unit of exceptional strength is produced. Preferably, the unit is prestressed to put the rods 34, 35 and 36 in tension. This is accomplished by placing jacks 72 between the adjacent sides of the modules 68, as indicated in FIGS. 18 and 20.

With the triangles 68 grouped as indicated in FIG. 18, it is preferred to provide vertical walls for the assembly to give it greater depth. This also serves to close out the spaces between the adjacent triangles 68, providing a larger assembly with a continuous horizontal concrete skin and a waffle pattern of concrete walls extending from one side of the skin. The walls are easily formed by providing forms 74 and 75 along the adjacent edges of the spaced triangles, as illustrated in FIGS. 21–25. The rods 70 used in interconnecting the straps 32 at the apexes of the triangles 68 are made long enough to extend the full depth of the forms 74 and 75, and normally project upwardly beyond the forms so that they can be used in making additional attachments when even larger assemblies are made. Spaced vertical rods 76 also are provided so as to extend between the adjacent edges of the modules 68 and between the forms 74 and 75, projecting outwardly past the forms as do the rods 70 (see FIG. 25). The vertical rods 76 are welded to the horizontal rods 71, having bent lower ends 77 that hook onto the horizontal rods.

With the forms positioned in the manner shown in FIGS. 21–25, ferrocement is poured into the spaces thus defined. As before, an epoxy coating may be used in advance of the casting of the cement to improve the bond. The end result is a wall 78 projecting outwardly from each pair of adjacent sides of the triangles 68, filling also the space between the adjacent triangle sides. This also covers the end loop 37, 38 and 39 of the rods 34, 35 and 36 of the strength units 31 and the horizontal rods 71 that interconnect the loops of the strength units.

Figure 25:
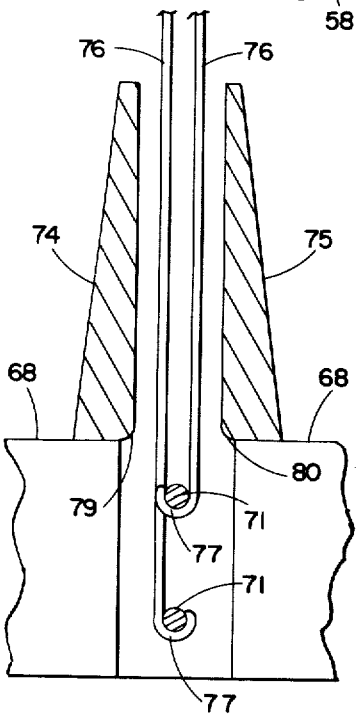
FIG. 25 is an enlarged sectional view showing the arrangement of the reinforcing rods and the mold sections used in forming the walls for the triangular assembly.

The lower corners of the forms 74 and 75 may be convexly rounded, as shown in FIG. 25, and extend inwardly of the sides of the modules 68. As a result, the walls 78 are thinner above the triangles 68 than between them. The assembly is vibrated as the concrete for the walls 78 is cast to assure that the concrete will flow beneath the undercuts provided by the corners 79 and 80.

Figure 26:
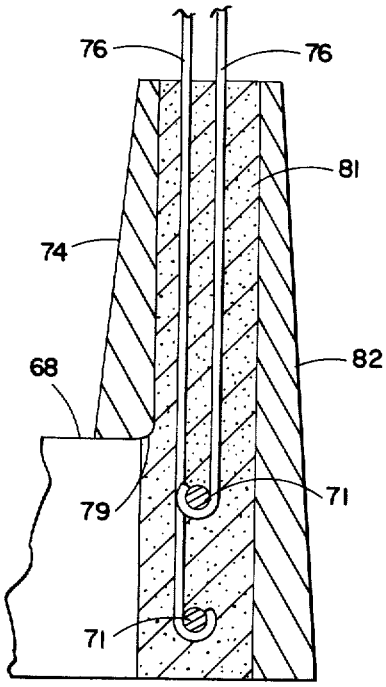
FIG. 26 is a view similar to FIG. 25 showing the arrangement for the walls at the side edges of the triangular assembly.

In addition to the interior walls 78, outer vertical walls 81 are provided, utilizing forms 75 and additional deeper elongated forms 82 (see FIG. 26).

Somewhat the same technique is followed in assembling the triangles 68 in rows with spaces between adjacent triangles, as seen in FIG. 27. At each location where the apexes are in adjacency, they are positioned with equal spacing about an imaginary circle having its center at the midpoint of the space between the apexes. With only a maximum of three triangles 68 being assembled at any corner, only those with the straps 32*a*, 32*b* and 32*c* need be used. This will provide the necessary overlapping relationship at the corners, allowing the pins 70 to extend through the aligned strap openings 32. In assuring that the necessary overlapping relationship will occur, the triangles are positioned so that they all point in the same direction. In the arrangement shown in FIG. 27, the straps 32*b* point upwardly for all of the triangles 68 in the assembly, while the straps 32*a* and 32*c* are at the lower left-hand and right-hand corners, respectively.

Horizontal rods 71 again are used along the sides of the assembled triangles. The rods 71 are threaded through the loops 37, 38 and 39 to which they are welded. The rods 71 also extend to the corners of the spaces between the triangles, being welded to the straps 32 and providing a unitary, horizontal, triangular connecting arrangement around the perimeters of the adjacent triangles 68.

Following this, vertical walls are provided at the boundaries of the triangles 68. This is accomplished through the use of forms similar in shape to the forms 74 and 82 of FIG. 26, providing elongated spaces into which ferrocement is cast. The surfaces of the triangles are coated with epoxy before the casting for improved adhesion. Vertical rods 76 again are employed and project above the top edges of the forms. Therefore, when the walls 85 are completed, the ends of the rods 70 and 76 project above the walls.

Figure 29:
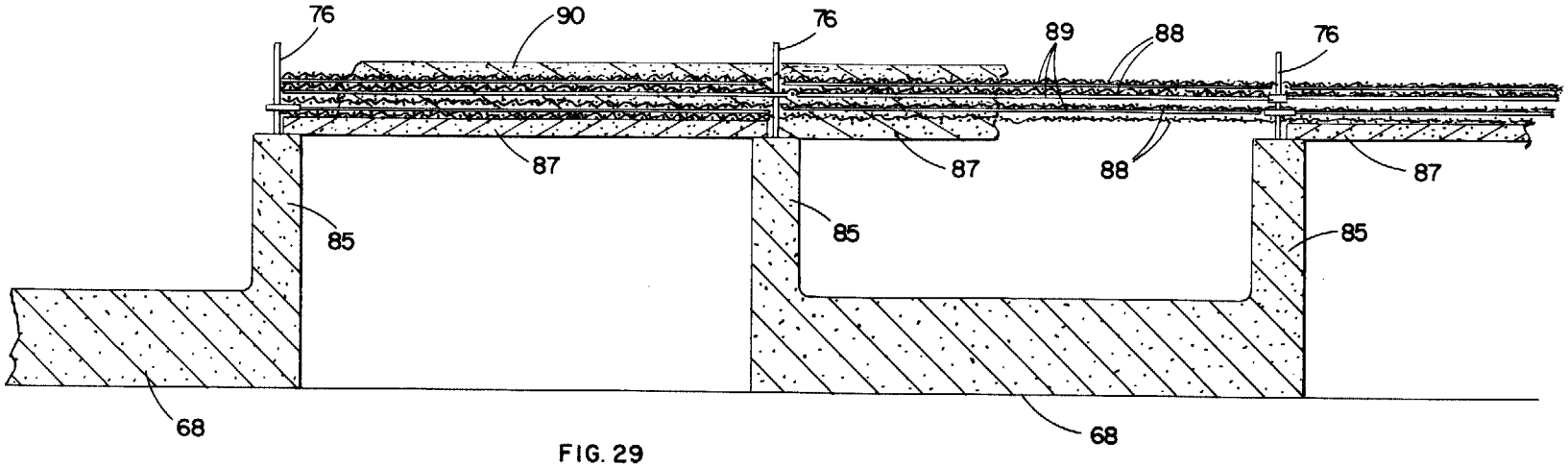
FIG. 29 is a fragmentary sectional view showing the assembly of FIG. 27 with the reinforcement and a portion of the skin secured thereto.
Figure 28:
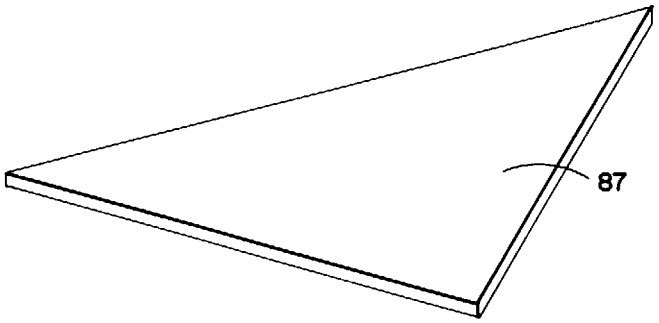
FIG. 28 is a perspective view of a triangular slab used in forming the base of the skin for the triangular assembly of FIG. 27.

After this, a floor is provided over the assembled triangles, connecting to the tops of the walls 85. As a part of the floor, relatively thin, flat reinforced cement triangles 87 are positioned over the spaces between the walls 85 of adjacent modules 68 (FIGS. 28 and 29). The flat triangles 87 are dimensioned so that they overlap the walls 85, with their edges spaced from the upwardly projecting rods 70 and 76. The triangles 87 also may be positioned to overlap the other edges of the walls 85 and extend above and parallel to the triangles 68. Over the triangles 87 are positioned layers of wire mesh reinforcing 88 alternating with enlarged strength units 89. The enlarged strength units 89 are similar to the strength units 31 described above and are arranged in a like manner with respect to the triangular modules. The rods 70 and 76 are secured to the wire mesh 88 and, where possible, to the rods of the strength unit 89. With the reinforcing thus in place, ferrocement is cast over the top to provide a floor 90. This completes a larger triangular unit 91 (shown inverted in (FIG. 30). which then is ready for attachment to other similar units 91 in providing an island assembly. The latter grouping need not be triangular as the units 91 may be assembled to form an island of hexagonal or other shape. Many of the units 91 may be grouped in providing relatively large floating islands. Additional structures may be built on top of the assembled units 91, both in providing increased depth and in producing necessary buildings and equipment.

The flat triangles 87 act as forms which prevent the ferrocement from dripping down from the floor 90 into the spaces between the triangles 68. This produces a smooth bottom wall for each of the pockets in the triangular unit 91, enhancing the resistance to damage from marine life when the island is in use. The triangles 87 may be omitted over the tops of the triangles 68, because this does not affect the surface presented to the exterior of the triangle. The wire mesh 88 is fine and retains most of the relatively dry ferrocement mixture used in making up the floor 90.

Figure 31:
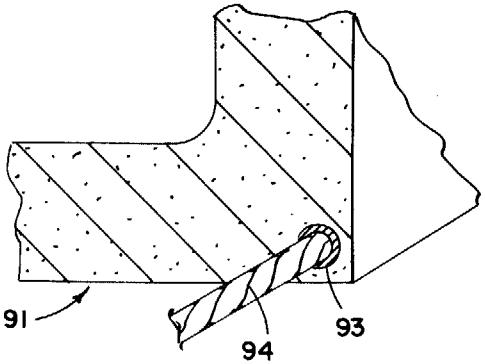
FIG. 31 is a fragmentary perspective view, partially in section, showing how larger floating modules may be secured together at their lower portions by means of cables.

In addition to the attachment of the triangles 68 by the various reinforcing elements described above, cable can be utilized in holding these triangles into the larger assemblies 91. Generally, these will be at the lower portions of these triangles, where attachment by the other reinforcing elements would be difficult to achieve. Normally, the triangular assemblies 91 will be floated at the time they are attached together because, by being large units, they are not adapted for transport from land to a body of water. Therefore, their lower portions will be under water, making it impractical to provide the same welded attachments for reinforcements as described above. Cables, however, can be fastened easily to the underwater portions. In order to effect the attachment through cables, conduits 93 are provided through at least portions of the triangles 68 at a location close to where the waterline will be, as illustrated in FIG. 31. Through the conduits 93 are extended cables 94, which are secured together to help fasten the triangles 68 to each other. The cables 94 may be placed under tension as the assembly is completed.

Rather than fabricating the triangular modules as in the embodiments described above, it is possible also to produce triangular units, including those of relatively large size, through a casting process. In accomplishing this, there is prepared a basket assembly 96, shown in FIG. 32, that provides reinforcement for the completed module. The basket assembly 96 includes a series of equally spaced, parallel, upper and lower horizontal rods 97 and 98, respectively, which extend along locations corresponding to the vertical walls to be provided in the completed cast unit. Again, the overall shape provided by the rods 97 and 98 is triangular, while triangular spaces are formed internally by the intersecting rods. Some of the rods that extend across the interior of the triangular framework overlap the longer rods at the side edges of the unit 96 to provide outwardly projecting rod end portions. These rod ends 99 and 100 for the rods 97 and 98, respectively, define openings to receive additional rods in assembling the completed cast modules into larger units. Tabs 101 and 102 also project outwardly from the rods 97 and 98 at the corners of the basket assembly, providing aligned openings to receive vertical pairs used in the grouping of the completed modules.

The basket assembly 96 also includes wire mesh sections 103, which are doubled over so as to receive and extend between the upper and lower sets of rods 97 and 98, as seen in FIG. 33. The wire mesh parts 103 are dimensioned in length to fit between the corners of the triangular divisions defined by the intersecting rods 97 and 98. The wire mesh is welded to the rods 97 and 98. Additional wire mesh 104 in flat sheet form is positioned over the top of the unit 96, and welded to the rods 97.

The completed basket assembly 96 is placed in a mold 105, shown in FIGS. 34, 35 and 36. The latter unit has sidewalls 106 defining an overall triangular shape, while within it are spaced triangular raised portions 107. The height of the latter is less than that of the sidewalls 106. The adjacent sidewalls 108 of the raised triangular portions 107 are divergent upwardly away from the bottom 109 of the mold. Also, the inner surfaces of the sidewalls 106 incline outwardly toward the top of the mold. The spaces between the triangular portions 107 and adjacent the sidewalls 106 are dimensioned to receive the lower part of the basket assembly 96 with some clearance. The rods 97 and the wire mesh sheet 104, however, are positioned slightly above the upper surfaces of the triangular mold portions 107 but below the tops of the sidewalls 106.

Adjacent the corners of the triangular mold portions 107 which are next to the sidewalls 106 of the mold, vertical slots 110 are formed in the sidewalls 106. The projecting ends 99 and 100 of the rods 97 and 98 extend through the slots 110 when the basket assembly 96 is introduced into the mold 105. The mold may be closed around the rod ends by means of slides 111 along the outside of the sidewalls 106 of the mold. The slides 111 are movable horizontally, guided by pins 112 that extend through horizontal slots 113 in the slides. Additional horizontal slots 114, extending to the vertical edges of the slides and open at their ends, are adapted to receive the rod ends 99 and 100. The slides 111 are moved to the left, as the device is shown in FIG. 34, to open the vertical slots 110 in the sidewalls 106 when the basket assembly 96 is to be placed in the mold. Then, the slides 111 are moved horizontally to the right so that their slots 114 receive the rod ends 99 and 100, and the slides 111 are positioned over the vertical slots 110 to form closures for the latter openings.

At the corners, there are pivotal closure elements 116 which allow the tabs 101 and 102 to extend out of the mold. The closure elements 116 have horizontal slots 117 through which the tabs 101 and 102 can extend. The closures 116 are pivotal about vertical hinges 119, allowing them to be swung open so that the corners of the mold do not obstruct the tabs 101 and 102 as the basket assembly is placed in the mold 105. When closed, the tabs 101 and 102 extend through the slots 117 and the corners of the mold are intact. In this manner, the interior of the assembly is sealed in the mold, while the ends of the rods and the tabs can project outwardly from the mold.

Next, the mold 105 is vibrated and ferrocement 120 is cast into it. This cement flows through the interstices of the wire mesh units 103 and 104, filling the space within the mold. The basket assembly becomes embedded within the cement 120, with the exception of the outwardly projecting rod ends 99 and 100 and the tabs 101 and 102. The upper surface 121 of the cement is finished to a flat smooth contour.

After the cement 120 cures, the completed unit is removed from the mold 105, being readily separable from the mold by virtue of the draft resulting from the upwardly divergent sidewalls within the mold cavity. The resulting structure is a unitary reinforced concrete module 122 having a solid triangular wall, continuous sides, and intermediate triangular honeycomb sections. The ends 99 and 100 of the rods 97 and 98 project outwardly from the sides of the module 122 for engagement with rods for attachment to additional modules in forming larger assemblies as in the arrangements described above. Also, the projecting tabs 101 and 102 receive vertical pins as such assemblies are made. The modules 122 are of great strength, being effectively reinforced by the basket assembly 96. If desired, a second skin may be provided over the exposed honeycomb structure to result in a completely enclosed unit.

What is claimed is:

1. A buoyant structure comprising a plurality of elements, each of said elements including three walls arranged in an edge-to-edge relationship to define a triangular shape, said elements being arranged in an assembly of a plurality of rows of said elements, with the bases of said elements being in end-to-end alignment in each of said rows, with the bases in one row being intermediate and interconnecting the apexes of the elements in the row adjacent thereto, said rows containing progressively one less of said elements from one side of said assembly to the other, thereby to provide said assembly with an overall triangular configuration, and to define triangular spaces between adjacent elements, said elements including means defining apertures at the apexes thereof, attaching means extending through said apertures for securing said elements to each other, and skin means covering at least a portion of said assembly.

2. A buoyant structure as recited in claim 1 in which said means defining apertures include rods forming loops at said apexes, and in which said attaching means includes a rod means at each of said apexes extending through said loops and secured thereto.

3. A buoyant structure comprising a plurality of elements, each of said elements including three walls arranged in an edge-to-edge relationship to define a triangular shape, said elements being arranged in an assembly of a plurality of rows of said elements, with the bases of said elements being in end-to-end alignment in each of said rows, with the bases in one row being intermediate and interconnecting the apexes of the elements in the row adjacent thereto, said rows containing progressively one less of said elements from one side of said assembly to the other, thereby to provide said assembly with an overall triangular configuration, and to define triangular spaces between adjacent elements, and skin means covering at least a portion of said assembly, said skin means including a concrete sheet extending over said elements, and reinforcement within said concrete sheet, said reinforcement including portions projecting outwardly beyond the edges of said sheet for attachment to other structures, said reinforcement including a plurality of rods, there being at least one of said rods extending from each apex of said assembly to the side opposite said apex and beyond the edge of said opposite side for providing said portions for attachment to other structures.

4. A buoyaant structure as recited in claim 3 in which there are at least three of said rods extending outwardly from each of said apexes to the side opposite thereto.

5. A buoyant structure as recited in claim 3 including in addition means attached to said rods and extending outwardly from said assembly at said apexes for providing additional attaching means.

6. A buoyant structure comprising a plurality of hollow substantially triangular concrete modules, reinforcement in each of said modules, said reinforcement including members capable of absorbing tension loads extending across said modules from substantially at the apexes thereof to the opposite sides thereof, said members having end portions outwardly of said modules at said apexes and at said opposite sides, and means interconnecting said end portions to provide a unitary assembly.

7. A buoyant structure as recited in claim 6 including in addition means urging apart adjacent modules in said assembly for thereby producing tension in said members.

8. A buoyant structure as recited in claim 6 in which said members are rods extending from the apexes of each module to the opposite sides thereof.

9. A buoyant structure as recited in claim 6 in which said means interconnecting said end portions include horizontal rods attached thereto, and including vertical concrete walls extending from the side edges of said modules to provide a honeycomb structure, said walls receiving and embedding said horizontal rods and said end portions, and vertical rods extending through said vertical walls, said vertical rods being attached to said horizontal rods and projecting outwardly beyond the upper edges of said vertical walls.

10. A buoyant structure as recited in claim 9 including a horizontal wall over the upper edges of at least a portion of said vertical walls, and reinforcement in said horizontal wall, said vertical rods being attached to said reinforcement in said horizontal wall.

11. A buoyant structure comprising a plurality of modules, each of said modules including three walls arranged to provide a substantially triangular shape, said modules being arranged in an assembly of a plurality of rows of said modules, with the bases of said modules being substantially in end-to-end alignment in each of said rows, with the bases in one row being intermediate the apexes of the modules in the row adjacent thereto, skin means covering at least a portion of said assembly, a strength unit for each of a plurality of said modules, each of said strength units including an element capable of absorbing tension loads, said element extending across the module with which it is associated from a first location substantially at the apex thereof to a second location at the side thereof opposite said apex thereof, means interconnecting said elements at said second locations, and means interconnecting said elements at said first locations, for transmitting stresses through said assembly by means of said strength units.

12. A buoyant structure as recited in claim 11 in which a plurality of said modules include three of said strength units with one of said elements extending across the same from each of the apexes thereof to each of the opposite sides thereof.

13. A buoyant structure as recited in claim 12 in which each of said strength units includes a plurality of said elements substantially in juxtaposition with each other at the apex from which they extend and spaced apart at the opposite side to which they extend.

14. A buoyant structure as recited in claim 13 in which each of said strength units includes three of said elements.

15. A buoyant structure as recited in claim 14 in which said elements are rods.

16. A buoyant structure as recited in claim 14 in which said elements where extending across said modules are buried in said skin means.

17. A buoyant structure as recited in claim 12 including in addition means urging said modules apart for placing said elements in tension thereby to prestress the same.

18. A buoyant structure as recited in claim 11 in which said rows contain progressively fewer of said modules from one side of said assembly to the other thereby to provide said assembly with a substantially triangular overall configuration.

19. A buoyant structure as recited in claim 18 including a plurality of said assemblies arranged in a larger assembly of a plurality of rows of said assemblies, with the bases of said assemblies being substantially in end-to-end alignment in each of said rows of said larger assembly, with the bases in one row of said larger assembly being intermediate the apexes of the assemblies in the row of said larger assemblies adjacent thereto, a larger strength unit for each of a plurality of said assemblies, each of said larger strength units including a larger element capable of absorbing tension loads, said larger element extending across the assembly with which it is associated from a first location substantially at the apex thereof to a second location at the side opposite said apex thereof, means interconnecting said larger elements at said second locations, and means interconnecting said larger elements at said first locations, for transmitting stresses through said larger assembly through said larger strength units.

* * * * *